US012297623B2

(12) United States Patent
Gulati et al.

(10) Patent No.: US 12,297,623 B2
(45) Date of Patent: May 13, 2025

(54) SYSTEM AND METHOD FOR CONTROLLING LOAD DEPENDENT VALVE FLOW WITH AN OVERRUNING LOAD

(71) Applicant: CNH Industrial America LLC, New Holland, PA (US)

(72) Inventors: Navneet Gulati, Naperville, IL (US); Joshua D. Zimmerman, Plainfield, IL (US)

( * ) Notice: Subject to any disclaimer, the term of this patent is extended or adjusted under 35 U.S.C. 154(b) by 344 days.

(21) Appl. No.: 18/075,604

(22) Filed: Dec. 6, 2022

(65) Prior Publication Data

US 2024/0183127 A1 Jun. 6, 2024

(51) Int. Cl.

| | |
|---|---|
| ***E02F 9/22*** | (2006.01) |
| ***E02F 3/42*** | (2006.01) |
| ***E02F 3/43*** | (2006.01) |
| *E02F 3/14* | (2006.01) |

(52) U.S. Cl.

CPC ..... *E02F 9/2203* (2013.01); *E02F 3/422* (2013.01); *E02F 3/431* (2013.01); *E02F 9/2228* (2013.01); *E02F 3/141* (2013.01)

(58) Field of Classification Search

CPC ..... E02F 9/2203; E02F 3/422; E02F 3/431; E02F 9/2228; E02F 9/2235; E02F 9/2285; E02F 9/2292; E02F 9/2296; F04B 49/605; F15B 11/08; F15B 11/165; F15B 2211/40561; F15B 2211/6054; F15B 2211/632; F15B 2211/635; F15B 2211/6355; F15B 13/02; F15B 15/18; F15B 2211/327; F15B 21/14; F15B 2211/20515; F15B 2211/20561; F15B 2211/212; F15B 2211/27; F15B 2211/613; F15B 2211/625; F15B 2211/7054

USPC ..... 701/50; 60/327, 459

See application file for complete search history.

(56) References Cited

U.S. PATENT DOCUMENTS

| | | | |
|---|---|---|---|
| 7,430,953 | B2 | 10/2008 | Bitter |
| 8,857,168 | B2 | 10/2014 | Opdenbosch |
| 8,863,509 | B2 | 10/2014 | Opdenbosch et al. |
| 9,020,708 | B2 | 4/2015 | Yamamoto et al. |
| 9,133,605 | B2 | 9/2015 | Pomeroy et al. |

(Continued)

FOREIGN PATENT DOCUMENTS

| | | |
|---|---|---|
| EP | 3385456 | 10/2018 |
| WO | 2012129042 | 9/2012 |

*Primary Examiner* — Andrew Joseph Rudy

(74) *Attorney, Agent, or Firm* — Rickard DeMille; Rebecca L. Henkel; Peter K. Zacharias

(57) ABSTRACT

A method for controlling load dependent valve flow rate in a presence of an overrunning load in a bucket includes receiving a measured pressure from and/or to a hydraulic valve, and the hydraulic valve is coupled to an actuator coupled to the bucket. The method includes calculating a load pressure on the actuator based on the measured pressure. The method includes receiving a first valve command for actuating the actuator to lower the bucket, the first valve command being associated with a desired valve flow rate and a desired maximum speed of the actuator. The method includes providing a second valve command based on a last calculated load pressure before receiving the first valve command, wherein the second valve command adjusts a valve opening area of the hydraulic valve so that a speed of the actuator corresponds to a maximum speed of the actuator for the last calculated load pressure.

20 Claims, 5 Drawing Sheets

(56) References Cited

U.S. PATENT DOCUMENTS

| | | | | |
|---|---|---|---|---|
| 9,316,236 | B2 | 4/2016 | Kondo et al. | |
| 9,429,175 | B2 | 8/2016 | Coolidge | |
| 9,644,650 | B2 | 5/2017 | Kim | |
| 10,393,151 | B2 | 8/2019 | Ueda | |
| 10,626,578 | B2 | 4/2020 | Izumi et al. | |
| 10,677,274 | B2 | 6/2020 | Kondo et al. | |
| 11,530,524 | B2 * | 12/2022 | Pintore | E02F 9/2228 |
| 2014/0165546 | A1 * | 6/2014 | Metzger | F04B 49/065 60/459 |
| 2020/0124194 | A1 | 4/2020 | Busani et al. | |
| 2020/0407945 | A1 | 12/2020 | Okada | |
| 2024/0151003 | A1 * | 5/2024 | Takagawa | E02F 9/2203 |

* cited by examiner

SYSTEM AND METHOD FOR CONTROLLING LOAD DEPENDENT VALVE FLOW WITH AN OVERRUNING LOAD

BACKGROUND

The present disclosure relates generally to work vehicles and, more particularly, to a system or method for controlling load dependent valve flow with an overrunning load.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A loader (e.g., wheel loader, skid-steer loader, etc.) is commonly used to load and move substantial volumes of material (e.g., dirt and similar material) from one location to another. A loader includes a relatively large frame and an implement (e.g., bucket) mounted to one end of the frame. The implement may be selectively elevated and selectively tilted to dump materials therefrom. An actuator (e.g., hydraulic cylinder) controls movement (e.g., lowering) of a linkage (e.g., boom) coupled to the bucket that holds the load (e.g., payload). On certain loaders, controlling valve flow (e.g., of a hydraulic valve coupled to the hydraulic cylinder) in the presence of an overrunning load is a problem. For example, in a skid-steer loader, the flow rate through the valve when lowering the boom is function of both valve opening and pressure drop across the valve to the tank or reservoir. Thus, if the system is configured to lower the boom in a given time period (e.g., 3 seconds) with an empty bucket, then the lowering speed of the boom will increase as weight is put in the bucket. For productivity, the valve is sized for the fast lowering speed (and to give a target boom down cycle time) as normally the bucket is empty when being lowered (as the load is normally dumped after being lifted but before lowering). However, in cases where the loader is used as a fork lift or any other application where a load is lowered, the controllability of lowering the boom becomes unacceptable due to the higher flow rates which result from having the same valve opening area but a higher pressure drop to the tank (i.e., higher load forces force more flow through the valve). This poor controllability may result in uncomfortable or unsafe operation or could cause damage to the load or loss of the load.

In another system such as a wheel loader bucket, the valve may be configured to have recirculation flow between the head side and the rod side of the hydraulic cylinder. This enables faster dumping when gravity is assisting the motion and requires less flow from the pump. However, in cases where it is desired to control the flow while moving the bucket with a gravity assisted load, this becomes difficult because the flow is dependent on the load. Therefore, there is a need in certain loaders to control load dependent flow in the presence of an overrunning load (i.e., a load that forces an actuator to move faster than pump flow can fill it).

BRIEF DESCRIPTION

This brief description is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a method for controlling load dependent valve flow rate in a presence of an overrunning load in a bucket of a work vehicle is provided. The method includes receiving, at a controller, a first valve command for actuating an actuator coupled to the bucket to lower the bucket with the overrunning load, wherein the first valve command is received from an operator interface of the work vehicle, and wherein the first valve command is associated with a desired valve flow rate through a hydraulic valve coupled to the actuator. The method also includes receiving, at the controller, feedback from one or more pressure sensors, wherein the feedback represents one or more measured pressures from and/or to the hydraulic valve. The method further includes obtaining, via the controller, characteristics of the hydraulic valve. The method even further includes calculating, via the controller, a valve flow rate through the hydraulic valve based on the first valve command, the one or more measured pressures, and the characteristics of the hydraulic valve. The method still further includes providing, via the controller, a second valve command to adjust a valve opening area of the hydraulic valve so that the valve flow rate matches the desired valve flow rate to control a speed of the actuator.

In another embodiment, a method for controlling load dependent valve flow rate in a presence of an overrunning load in a bucket of a work vehicle is provided. The method includes receiving, at the controller, feedback from one or more pressure sensors, wherein the feedback represents one or more measured pressures from and/or to a hydraulic valve, and the hydraulic valve is coupled to an actuator coupled to the bucket with the overrunning load. The method also includes calculating, via the controller, a load pressure on the actuator based on the feedback. The method further includes receiving, at the controller, a first valve command for actuating the actuator to lower the bucket with the overrunning load, wherein the first valve command is received from an operator interface of the work vehicle, and wherein the valve command is associated with a first desired valve flow rate through the hydraulic valve and a first desired maximum speed of the actuator. The method even further includes providing, via the controller, a second valve command based on a last calculated load pressure before receiving the first valve command, wherein the second valve command adjusts a valve opening area of the hydraulic valve so that a speed of the actuator corresponds to a maximum speed of the actuator for the last calculated load pressure.

In a further embodiment, a method for controlling actuator speed in a presence of an overrunning load in a bucket of a work vehicle is provided. The method includes receiving, at a controller, a first input from an operator interface of the work vehicle, wherein the first input includes a selected target speed from among a plurality of target speeds for an actuator coupled to the bucket, wherein the plurality of target speeds range between 0 percent and 100 percent. The method also includes determining, via the controller, a maximum valve command for actuating the actuator to lower the bucket with the overrunning load based on the selected target speed, wherein the maximum valve command ranges between 0 percent and 100 percent, and wherein the maximum valve command is associated with a valve flow rate through a hydraulic valve coupled to the actuator. The method further includes determining, via the controller, whether a speed limitation feature is enabled. The method even further includes adjusting, via the controller, the maximum valve command and providing the adjusted maximum valve command to the hydraulic valve, wherein the adjusted maximum valve command keeps the actuator from exceeding the target speed when the speed limitation feature is enabled. The method still further includes providing, via the controller, the maximum valve command to the hydraulic valve unadjusted when the speed limitation feature is not enabled.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Embodiments of the present disclosure relate generally to regulating flow (e.g., load dependent valve flow) through a valve (e.g., hydraulic control valve) coupled to an actuator (e.g., hydraulic cylinder) that controls movement of a bucket of a work vehicle holding the load when the load and the motion of the bucket are in the same direction (i.e., an overrunning load). Regulating the load dependent valve flow controls the speed of the actuator, which is also load dependent. In certain embodiments, active flow control with continuous pressure feedback may be utilized to regulate the load dependent valve flow. In certain embodiments, the flow may be limited based on a last measured load pressure on an actuator prior to receiving a valve command. In certain embodiments, active flow control with position feedback (of the actuator) may be utilized to regulate the load dependent valve flow. In certain embodiments, the load dependent valve flow may be regulated without the need of pressure feedback or position feedback (instead utilizing configurable speed control of the actuator). The disclosed embodiments provide better controllability to avoid unsafe operation and potential damage to the machine. In addition, the disclosed embodiments provides a lower cost option than installing a load independent flow control system.

Figure 1:
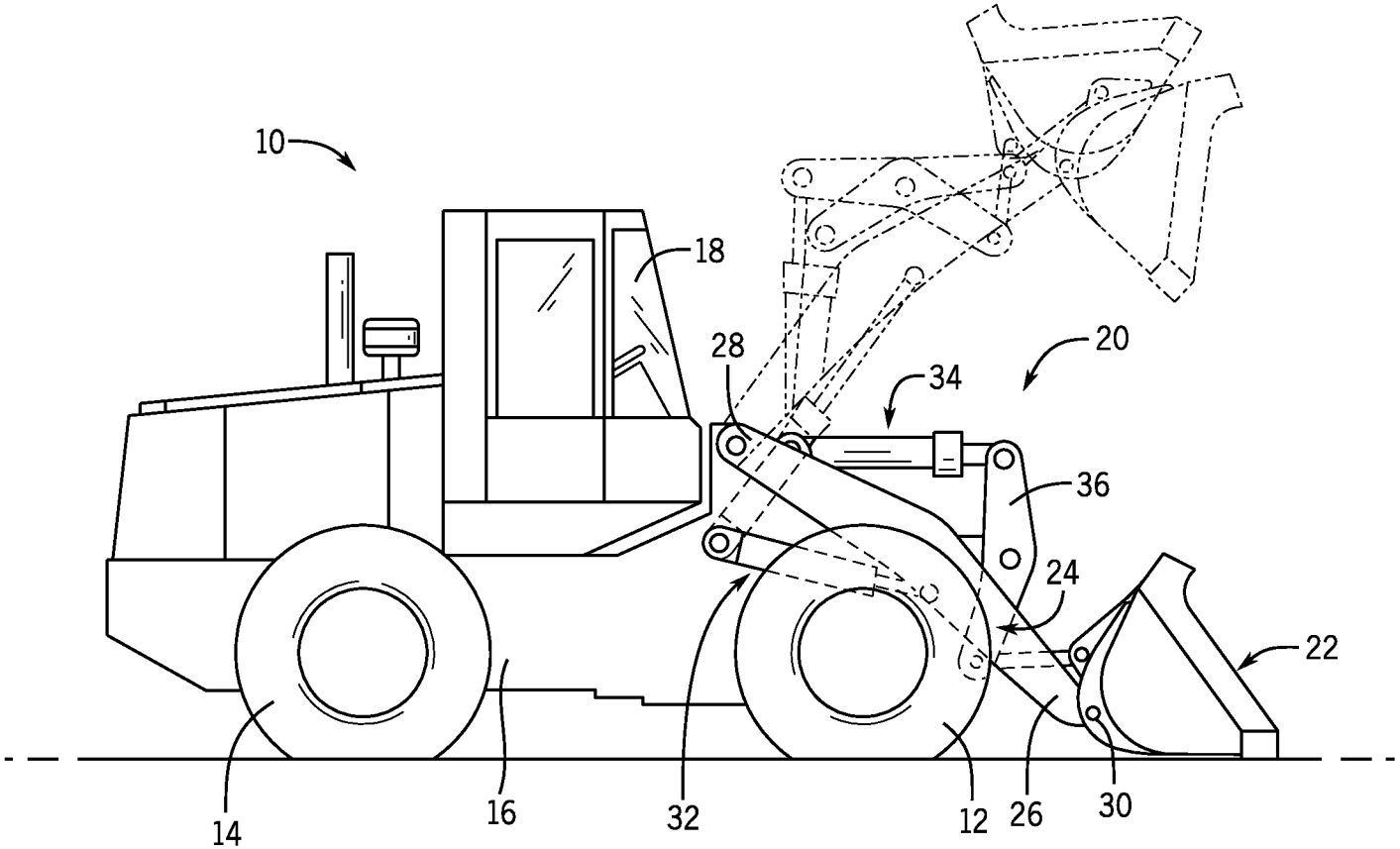
FIG. 1 illustrates a side view of a work vehicle (e.g., wheel loader) equipped with an implement (e.g., bucket), in accordance with aspects of the disclosure.

FIG. 1 illustrates a side view of a work vehicle 10 (e.g., wheel loader) equipped with an implement 22 (e.g., bucket). In certain embodiments, the work vehicle may be another type of loader such as a skid-steer loader having the implement 22 for handling a load. As shown, the work vehicle 10 includes a pair of front tires 12, (one of which is shown), a pair of rear tires 14 (one of which is shown) and a frame or chassis 16 coupled to and supported by the tires 12, 14. An operator's cab 18 may be supported by a portion of the chassis 16 and may house various input devices for permitting an operator to control the operation of the work vehicle 10.

Moreover, as shown in FIG. 1, the work vehicle 10 may include a lift assembly 20 (e.g., actuation system) for raising and lowering a suitable implement 22 (e.g., a bucket) relative to a driving surface of the vehicle 10. In several embodiments, the lift assembly 20 may include a pair of loader arms 24 (one of which is shown) pivotally coupled between the chassis 16 and the implement 22. For example, as shown in FIG. 1, each loader arm 24 (e.g., boom) may include a forward end 26 and an aft end 28, with the forward end 26 being pivotally coupled to the implement 22 at a forward pivot point 30 and the aft end 28 being pivotally coupled to a portion of the chassis 16.

In addition, the lift assembly 20 may also include a pair of hydraulic lift cylinders 32 (one of which is shown) coupled between the chassis 16 and the loader arms 24 and a hydraulic tilt cylinder 34 coupled between the chassis 16 and the implement 22 (e.g., via a pivotally mounted bell crank plate 36 or other mechanical linkage). It should be readily understood by those of ordinary skill in the art that the lift and tilt cylinders 32, 34 may be utilized to allow the implement 22 to be raised/lowered and/or pivoted relative to the driving surface of the work vehicle 10. For example, the lift cylinders 32 may be extended and retracted in order to pivot the loader arms 24 upward and downwards, respectively, thereby at least partially controlling the vertical positioning of the implement 22 relative to the driving surface. Similarly, the tilt cylinder 34 (e.g., bucket cylinder) may be extended and retracted in order to pivot the implement 22 relative to the loader arms 24 about the forward pivot point 30, thereby controlling the tilt angle or orientation of the implement 22 relative to the driving surface or ground. The number of linkages and/or cylinders of the lift assembly 20 may vary.

Figure 2:
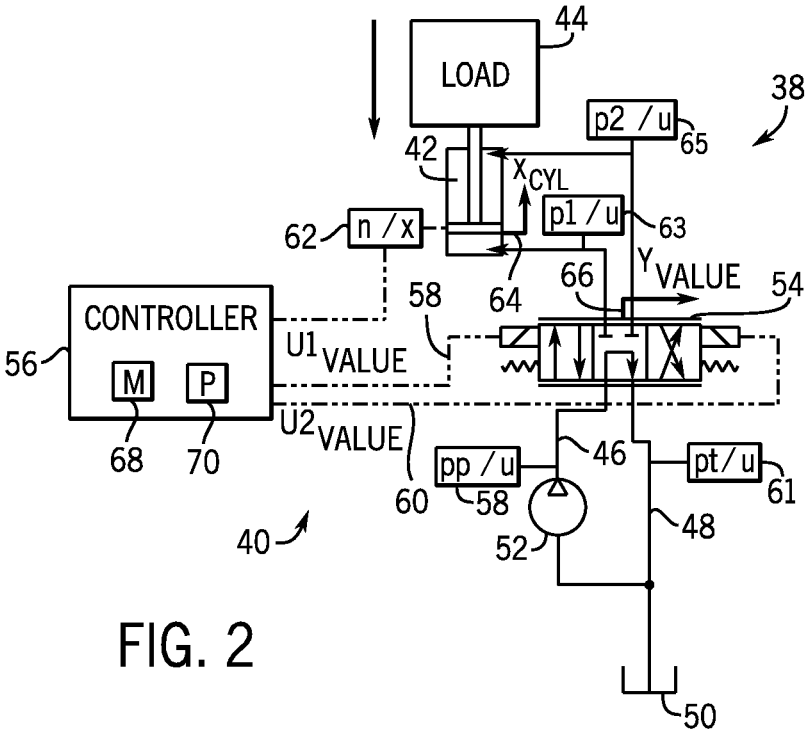
FIG. 2 illustrates a schematic diagram of a hydraulic payload system of the work vehicle in FIG. 1, in accordance with aspects of the present disclosure.

FIG. 2 is a schematic diagram of a hydraulic payload system 38 of the work vehicle 10 in FIG. 1. The hydraulic payload system 38 includes a control system 40 (e.g., electro-hydraulic control system) coupled to an actuator 42 (e.g., cylinder such as a bucket cylinder). The actuator 42 is coupled to an implement (e.g., implement 22 in FIG. 1) such as a bucket and, thus, a load 44 (e.g., payload) disposed in the implement. Fluid (e.g., hydraulic fluid) flow along conduits 46, 48 controls the operation of the actuator 42 and, thus, movement (and position) of the implement in a vertical direction relative to the ground (e.g., raising or lowering the implement). In certain embodiments, operation of the actuator involves changing a tilt position of the implement (e.g., bucket) about its horizontal axis. Fluid is provided from a reservoir 50 (e.g., tank) to the actuator 42 along the conduit 46 via a pump 52. Fluid is returned to the reservoir 50 via the conduit 48. A control valve 54 (e.g., electro-hydraulic valve) may be disposed along the conduits 46, 48. As depicted, the control valve 54 is a tandem center control valve. In certain embodiments, the control valve 54 may be an open center control valve. The control valve 54 is responsive to control signals from a controller 56 that causes the control valve 54 to regulate fluid flow to and from the actuator 42. For example, $u1_{valve}$ 58 is a command in a lift direction (relative to the ground) and $u2_{valve}$ 60 is a command in a lower direction (e.g., relative to the ground). The controller 56 also receives feedback from one or more position sensors 62 coupled to the actuator 42. The one or more position sensors 62 may include a linear position sensor, a joint angle sensor, accelerometers, gyroscopes, inertial measurement units, or other type of position sensor. For example, the feedback received from the one or more position sensors 62 includes a position measurement $x_{cyl}$ 64 (e.g., cylinder position measurement) of the actuator 42. In certain embodiments, the controller 56 also receives feedback from a valve position sensor coupled to the control valve 54. For example, the feedback received from the valve position sensor is a valve spool position $y_{valve}$ 66. The controller 56 receives feedback from pressure sensors disposed throughout the hydraulic system. For example, the controller receives pressure feedback from a pressure sensor 59 disposed between the pump 52 and the control valve 54, a pressure sensor 61 disposed between the control valve 54 and the reservoir 50, a pressure sensor 63 disposed between the control valve 54 and the actuator 42, and/or a pressure sensor 65 disposed between the actuator 42 and the control valve 54. In certain embodiments, only a single pressure sensor is needed between the actuator 42 and the control valve 54. In certain embodiments (e.g., a system having flow recirculation such as for actuation of a wheel loader bucket), two pressure sensors (e.g., pressure sensors 63, 65) are utilized.

The controller 56 contains computer-readable instructions stored in memory 68 (e.g., non-transitory, tangible, and computer-readable medium/memory circuitry) and a processor 70 which executes the instructions. More specifically, the memory 68 may include volatile memory, such as random access memory (RAM), and/or non-volatile memory, such as read-only memory (ROM), optical drives, hard disc drives, or solid-state drives. Additionally, the processor 70 may include one or more application specific integrated circuits (ASICs), one or more field programmable gate arrays (FPGAs), one or more general purpose processors, or any combination thereof. Furthermore, the term processor is not limited to just those integrated circuits referred to in the art as processors, but broadly refers to computers, processors, microcontrollers, microcomputers, programmable logic controllers, application specific integrated circuits, and other programmable circuits. The processor 70 and memory 68 may be used collectively to support an operating system, software applications and systems, and so forth, useful implementing the techniques described herein.

In certain embodiments, active flow control with continuous pressure feedback may be utilized to regulate the load dependent valve flow. Flow through an orifice is proportional to the square root of delta pressure. Using these known relations or using empirical mapping of valve command and pressure to flow, the flow rate can be predicted using feedback from the pressure sensors (59, 61, 63, and/or 65) and the valve command which dictates the area opening of the control valve 54. Pressure data can be utilized in a live fashion where feedback is dynamically used to regulate the valve command control actuator speed using known valve area profiles and known relationships between pressure and flow for a given area opening of the control valve 54. This could be further enhanced using the position sensor to detection the position, velocity, or acceleration of the actuator 42. Using the feedback, the controller 56 is configured to utilize a control algorithm to close the loop and regulate a final speed of the actuator.

Figure 3:
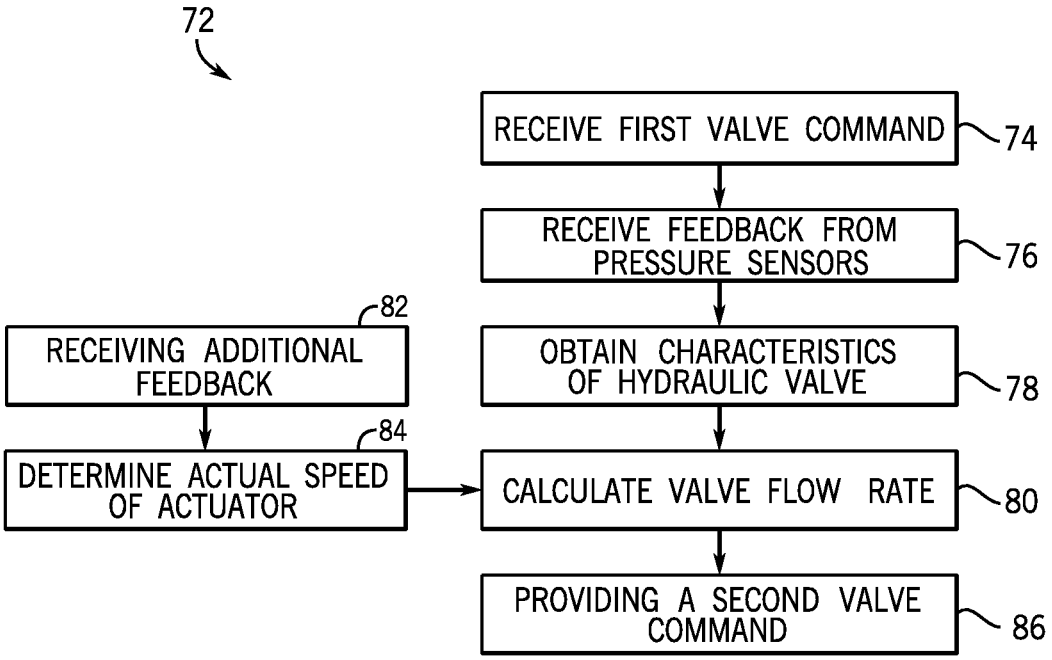
FIG. 3 illustrates a flow chart of a method for controlling load dependent valve flow rate in a presence of an overrunning load in a bucket of a work vehicle (e.g., utilizing active flow control with continuous pressure feedback), in accordance with aspects of the present disclosure.

FIG. 3 illustrates a flow chart of a method 72 for controlling load dependent valve rate in a presence of an overrunning load in bucket of a work vehicle (e.g., utilizing active flow control with continuous pressure feedback). One or more of the steps of the method 72 may be performed by the controller 56 in FIG. 2. One or more of the steps of the method 72 may be performed in a different order or simultaneously from that depicted in FIG. 3.

The method 72 includes receiving a first valve command for actuating an actuator coupled to the bucket to lower the bucket with the overrunning load, wherein the first valve command (e.g., joystick command) is received from an operator interface of the work vehicle, and wherein the valve command is associated with a desired valve flow rate (Q) through a hydraulic valve (e.g., control valve) coupled to the actuator (block 74). The main challenge is controlling Q while lowering the load (e.g., in the bucket). Q is determined by the following equation:

$$Q=K*A*swrt(p_1-p_t), \quad (1)$$

where Q represents the desired flow from the joystick command, K represents the valve flow gain (as determined from bench data such as empirical value considering fluid viscosity and flow geometries), A represents the valve opening area (as mapped from command or spool position), $p_1$ represents the measured pressure on the base side of the cylinder (e.g., actuator 42) (as measured by pressure sensor 63 in FIG. 2), and $p_t$ represents the measured pressure or estimated tank pressure (e.g., as measured by pressure sensor 61 in FIG. 2). In certain embodiments, the tank pressure can be estimated to be zero, a constant low pressure drop for a return check valve, or any other method of estimating the tank return line based on flow rate (e.g., empirical or equation similar to Equation 1). Equation 1 can be arranged for the valve opening area, A, by the following equation:

$$A=Q/(K*sqrt(p_1-p_t)). \quad (2)$$

Figure 4:
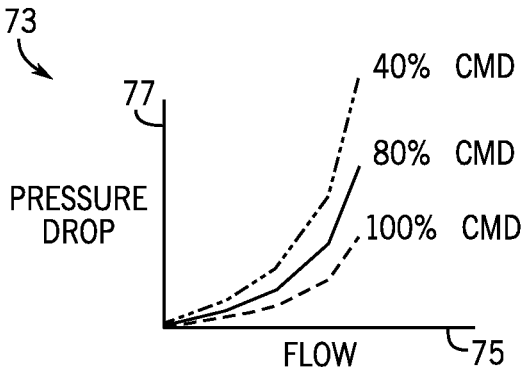
FIG. 4 illustrates a graph of pressure drop across a hydraulic valve relative to valve flow for different valve commands, in accordance with aspects of the present disclosure.

The relationship between the pressure drop across the hydraulic valve (e.g., $(p_1-p_t)$) and valve flow for a number of valve commands (e.g., 3 commands) is depicted in FIG. 4. Graph 73 in FIG. 4 includes an x-axis represents hydraulic flow 75 and the y-axis represents pressure drop 77.

The controller commands the valve opening area based on the joystick commanded flow, valve characteristics, and observed pressures. Returning to FIG. 3, the method 72 also includes receiving feedback from one or more pressure sensors, wherein the feedback represents one or more measured pressures from and/or to the hydraulic valve (block 76). As noted above, in certain embodiments (where flow is recirculated through the hydraulic cylinder), pressure measurements may be needed on a piston side of the hydraulic cylinder and on a rod side of the hydraulic cylinder.

The method 72 further includes obtaining characteristics of the hydraulic valve (block 78). The method 72 even further includes calculating a valve flow rate through the hydraulic valve based on the valve command, the one or more measured pressures, and the characteristics of the hydraulic valve (block 80). In certain embodiments, the valve flow rate is an estimated valve flow rate.

In certain embodiments, the method 72 includes receiving additional feedback from a sensor (e.g., position sensor 62 in FIG. 2) coupled to the hydraulic cylinder (e.g., actuator) (block 82). The additional feedback represents a position, a velocity, or an acceleration of the actuator. The method 72 may also include determining an actual speed of the actuator based on the additional feedback (block 82). The method 72 may further include calculating the valve flow rate (block 80). In this embodiment, the actual speed of the actuator is also utilized in calculating the valve flow rate. Also, in this embodiments, the valve flow rate is the actual valve flow rate.

The method 72 still further includes providing a second valve command to adjust a valve opening area of the hydraulic valve so that the valve flow rate matches the desired valve flow rate to control a speed of the actuator (block 86). The second valve command is based on a known relationship between valve command and valve opening area.

In certain embodiments, the flow rate may be limited based on a last measured pressure in an actuator prior to receiving a valve command. In practice, fluctuations in actuator pressure due to dynamic transients may make the system difficult to control in a stable manner. As a compromise between accuracy and controllability, the following technique (i.e., flow limit with sample and hold pressure feedback) may be utilized. While still utilizing feedback from the pressure sensors, the load may be observed dynamically. At the start of a command for boom lower or other gravity assist operation, it will be detected that the load is in the same direction as the commanded motion. The last observed load before command will be held in memory. The valve command will then be scaled and limited to a command that corresponds to the maximum desired actuator speed based on the observed load (i.e., the last observed load). For example, in a boom down system configured to lower in a cycle time of 3 seconds with no load, it could be detected that for a given load, the cycle of 3 seconds would be achieved with a 60 percent command. As such, the joystick command range would be scaled from 0 to 100 percent down to 0 percent to 60 percent (or saturated at 60 percent). The advantage of this system is that the controller will not become unstable. Since the load may change with position, in certain embodiments, position sensors may be utilized to add kinematic compensations to the command scaling to minimize these effects. As noted above, in certain embodiments (where flow is recirculated through the hydraulic cylinder), pressure measurements may be needed on a piston side of the hydraulic cylinder and on a rod side of the hydraulic cylinder.

Figure 5:
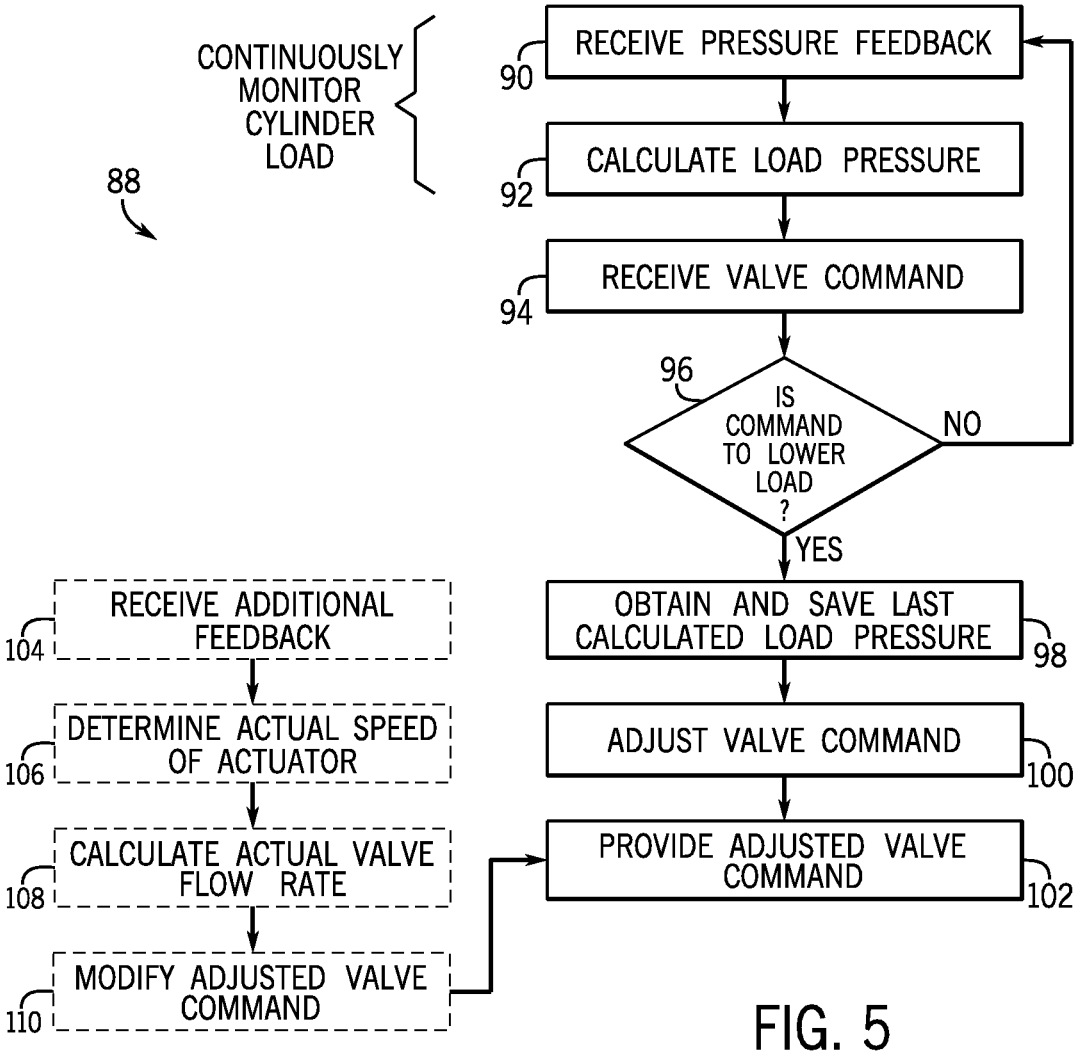
FIG. 5 illustrates a flow chart of a method for controlling load dependent valve flow rate in a presence of an overrunning load in a bucket of a work vehicle (e.g., utilizing flow limit with sample and hold pressure feedback), in accordance with aspects of the present disclosure.

FIG. 5 illustrates a flow chart of a method 88 for controlling load dependent valve flow rate in a presence of an overrunning load in a bucket of a work vehicle (e.g., utilizing flow limit with sample and hold pressure feedback). One or more of the steps of the method 88 may be performed by the controller 56 in FIG. 2. One or more of the steps of the method 88 may be performed in a different order or simultaneously from that depicted in FIG. 5.

The method 88 includes receiving feedback from one or more pressure sensors, wherein the feedback represents one or more measured pressures from and/or to a hydraulic valve (e.g., the control valve), and the hydraulic valve is coupled to an actuator (e.g., hydraulic cylinder) coupled to the bucket with the overrunning load (block 90). The method also includes calculating a load pressure on the actuator based on the feedback (block 92). Blocks 90 and 92 continuously occur to enable continuous monitoring of the cylinder load.

The method 88 further includes receiving a valve command (e.g., first valve command) (e.g., joystick command) for actuating the actuator to move the bucket with the load (block 94). The valve command is received from an operator interface of the work vehicle. The valve command is associated with a first desired valve flow rate through the hydraulic valve and a first desired maximum speed of the actuator. The method includes determining if the valve command is to lower the bucket (e.g., with an overrunning load) (block 96). If the valve command is not to lower the bucket, the method 88 proceeds with monitoring the cylinder load (blocks 90 and 92). If the valve command is to lower the load, the method 82 includes obtaining and saving the last calculated (i.e., observed) load pressure before the valve command in the memory (block 98).

The method 88 even further includes adjusting the valve command (e.g., the first valve command) based on the saved last calculated load pressure to generate an adjusted valve command (e.g., second valve command) (block 100). The adjusted valve command adjusts a valve opening area of the hydraulic valve (e.g., limiting the maximum flow rate) so that a speed of the actuator corresponds to a maximum speed of the actuator for the last calculated load pressure. In certain embodiments, adjusting the first valve command includes saturating the first valve command to generate the second valve command. In certain embodiments, adjusting the first valve command includes scaling the first valve command to generate the second valve command. In either case, scaling or saturation reduces the maximum speed. Scaling give better control resolution.

The method 88 still further includes providing the adjusted valve command (e.g., second valve command) (block 102). In certain embodiments, an additional valve command (e.g., third valve command) to lower the load may be received subsequent to providing the adjusted valve command (e.g., second valve command) which results in the method 88 repeating blocks 98 to 100 to provide another valve command (e.g., fourth valve command).

In certain embodiments, the method 88 includes receiving additional feedback from a sensor (e.g., position sensor 62 in FIG. 2) coupled to the hydraulic cylinder (e.g., actuator) (block 104). The additional feedback represents a position, a velocity, or an acceleration of the actuator. In certain embodiments, the method 88 may also include determining an actual speed of the actuator based on the additional feedback (block 106). In certain embodiments, the method 88 may further include calculating the actual valve flow rate (block 108). In certain embodiments, the method 88 may even further include modifying the adjusted valve command (e.g., the second valve command) based on the actual valve flow rate (block 110). The modification of the adjusted valve command may occur only if the actual valve flow rate is faster than the maximum desired flow rate, then the command can be reduced to get the flow to the desired limit.

Figure 6:
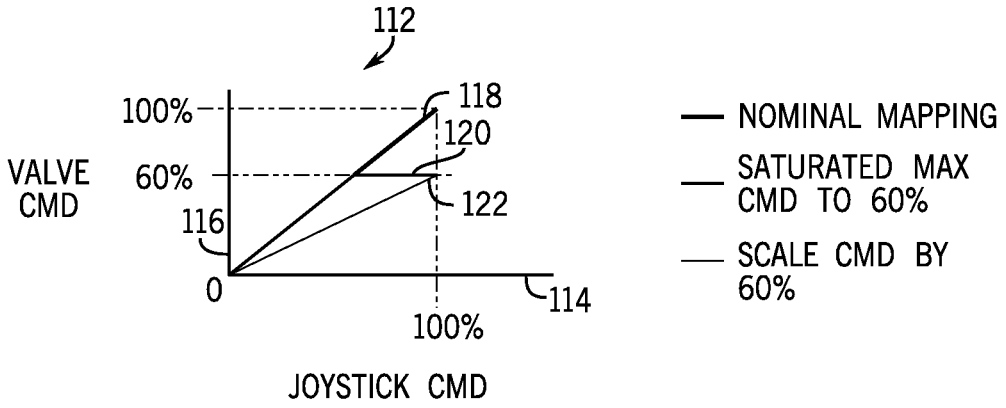
FIG. 6 illustrates a graph (e.g., mapping) of joystick command versus valve command in the presence of scaling or saturation, in accordance with aspects of the present disclosure.

FIG. 6 illustrates a graph 112 (mapping) of joystick command versus valve command in the presence of scaling or saturation. The x-axis 114 represents joystick command (e.g. from 0 percent to 100 percent) and the y-axis 116 represents valve command (e.g., from 0 percent to 100 percent). Line 118 represents nominal mapping. Line 120 represents a maximum command saturated to 60 percent. Line 122 represents scaling a command by 60 percent. The saturation or scale factor is determined based on the observed load pressure.

In certain embodiments, active flow control with continuous position feedback (of the actuator) may be utilized to regulate the load dependent valve flow. In particular, in response to the position feedback, a velocity or speed of the actuator may be determined. The controller may then dynamically regulate the control valve to limit the velocity or speed of the actuator during a gravity assisted motion (or overrunning load). In certain embodiments, the target velocity may be scaled with a joystick command. In certain embodiments, saturation in the command may occur when maximum velocity is observed. Theoretically, calling the command to a target velocity gives more precise control. However, in practice, implementing a saturation on flow/velocity could be more robust to avoid instabilities. In particular, to enhance control, knowledge of pressure/flow relationships of the hydraulic valve may be utilized, even in the absence of pressure sensors. The output velocity observed from the position sensor feedback relative to a given command may be utilized to predict the pressure in the system. The predicted pressure can then be used to assist in the control of the actuator speed as described in the methods. In certain embodiments, both pressure and position sensors could be utilized.

In certain embodiments, a configurable boom down (or actuator) speed may be utilized. In such a system, a display (or other user interface such as a knob) could be used to allow an operator to control the maximum boom down speed between 0 percent and 100 percent. In this system, the operator could enter a target speed through any input means into the system. The target speed would then be mapped to a maximum valve command between 0 percent and 100 percent. The valve command would then be scaled by this factor or saturated to this factor during normal operation to ensure that the maximum speed selected is never exceeded.

Using such a system, the operator could have a button to turn the speed limitation (or speed reduction) on/off quickly so that the last used speed limitation is kept in the memory. Then the operator could toggle the speed limitation on/off. Thus, during an operation that requires lowering a load, the operator can quickly activate the system and adjust the speed if necessary. When the operator returns to a more typical operation (e.g., lowering of empty loads), the system can be deactivated. The utilization of this configurable down speed technique may be utilized with any of the other speed control methods discussed above.

Figure 7:
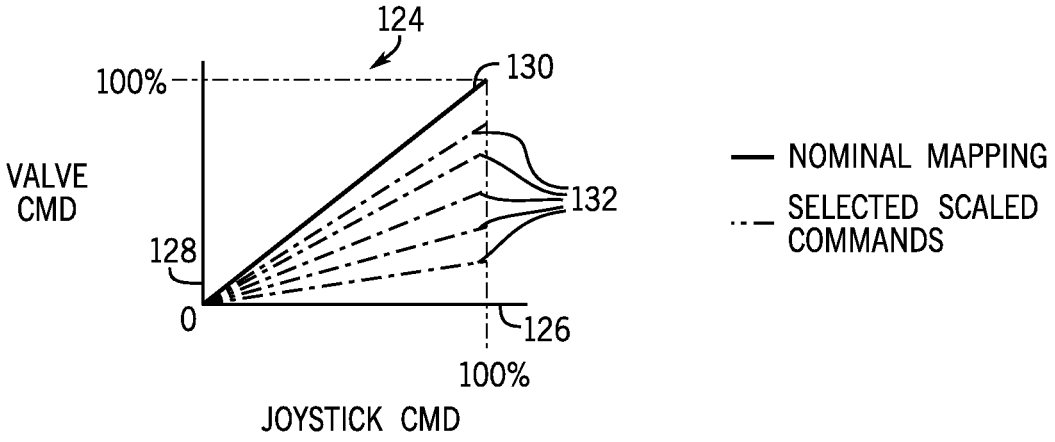
FIG. 7 illustrates a graph (e.g., mapping) of joystick command versus valve command with selectable scaled commands, in accordance with aspects of the present disclosure.

FIG. 7 illustrates a graph 124 (e.g., mapping) of joystick command versus valve command with selectable scaled commands. The x-axis 126 represents joystick command (e.g. from 0 percent to 100 percent) and the y-axis 128 represents valve command (e.g., from 0 percent to 100 percent). Line 130 represents nominal mapping. Lines 132 represent different selectable scaled commands that can be selected utilizing the configurable boom down speed system.

Figure 8:
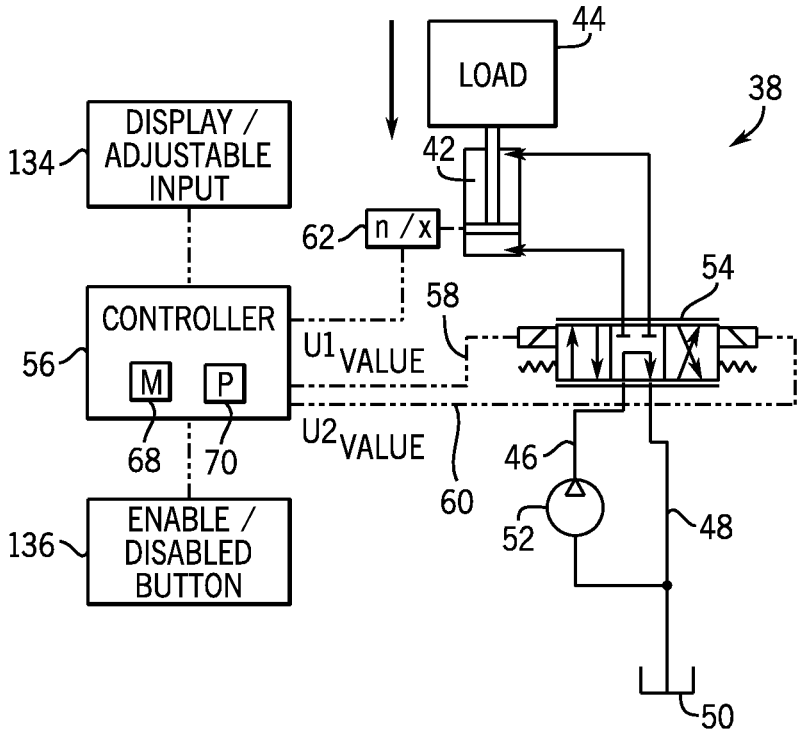
FIG. 8 illustrates a schematic diagram of a hydraulic payload system of the work vehicle in FIG. 1 (e.g., having an input device and button for enabling/disabling speed reduction), in accordance with aspects of the present disclosure.

FIG. 8 a schematic diagram of the hydraulic payload system 38 of the work vehicle in FIG. 1 (e.g., having an input device and button for enabling/disabling speed reduction). The hydraulic payload system 38 is as described in FIG. 2. In addition, the hydraulic payload system 38 includes an operator interface device 134 (such as a display or an adjustable input device (e.g., knob) to select a speed setting (e.g., max boom down speed or actuator speed (e.g., between 0 percent and 100 percent) in communication with the controller 56. The hydraulic payload system 38 also includes a button 136 for enabling or disabling (e.g., toggling on/off) the described speed reduction or speed limitation feature. The button 136 is in communication with the controller 56.

Figure 9:
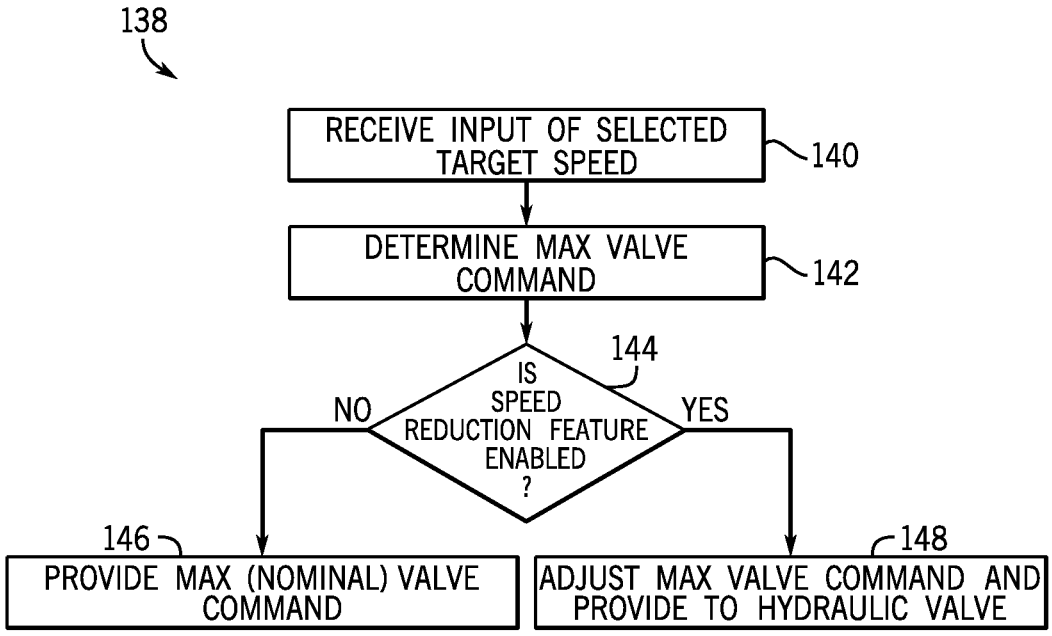
FIG. 9 illustrates a flow chart of a method for controlling actuator speed (e.g., in a presence of an overrunning load in a bucket of a work vehicle), in accordance with aspects of the present disclosure.

FIG. 9 illustrates a flow chart of a method 138 for controlling actuator speed (e.g., in a presence of an overrunning load in a bucket of a work vehicle). One or more of the steps of the method 138 may be performed by the controller 56 in FIG. 9. One or more of the steps of the method 138 may be performed in a different order or simultaneously from that depicted in FIG. 9. The method 138 may be utilized with the methods described above.

The method 138 includes receiving a first input from an operator interface (e.g., operator interface 134 in FIG. 8) of the work vehicle (block 140). The first input is a selected target speed from among a plurality of target speeds for an actuator coupled to the bucket, wherein the plurality of target speeds range between 0 percent and 100 percent. The method 138 also includes determining a maximum valve command for actuating the actuator to lower the bucket with the overrunning load based on the selected target speed (block 142). The maximum valve command ranges between 0 percent and 100 percent. Also, the maximum valve command is associated with a valve flow rate through a hydraulic valve coupled to the actuator.

The method 138 further includes determining where a speed limitation feature (or speed reduction feature) is enabled (block 144). When the speed limitation feature is not enabled, the method 138 includes providing the maximum valve command (or nominal valve command) to the hydraulic valve (block 146). When the speed limitation feature is enabled, the method 138 includes adjusting the maximum valve command and providing the adjusted maximum valve command to the hydraulic valve (block 148). The adjusted maximum valve command keeps the actuator from exceeding the target speed. In certain embodiments, adjusting the maximum valve command involves scaling the maximum valve command. Thus, the adjusted maximum valve command is a scaled command. In certain embodiments, the adjusting the maximum valve command involves saturating the maximum valve command.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method for controlling load dependent valve flow rate in a presence of an overrunning load in a bucket of a work vehicle, comprising:

receiving, at a controller, a first valve command for actuating an actuator coupled to the bucket to lower the bucket with the overrunning load, wherein the first valve command is received from an operator interface of the work vehicle, and wherein the first valve command is associated with a desired valve flow rate through a hydraulic valve coupled to the actuator;

receiving, at the controller, feedback from one or more pressure sensors, wherein the feedback represents one or more measured pressures from and/or to the hydraulic valve;

obtaining, via the controller, characteristics of the hydraulic valve;

calculating, via the controller, a valve flow rate through the hydraulic valve based on the first valve command, the one or more measured pressures, and the characteristics of the hydraulic valve; and providing, via the controller, a second valve command to adjust a valve opening area of the hydraulic valve so that the valve flow rate matches the desired valve flow rate to control a speed of the actuator.

2. The method of claim 1, wherein the actuator comprises a hydraulic cylinder and flow through the hydraulic cylinder is recirculated, and wherein the one or more pressure sensors comprises a first pressure sensor and a second pressure sensor, and the one or more measured pressures comprise a first pressure measurement on a piston side of the hydraulic cylinder and a second pressure measurement on a rod side of the hydraulic cylinder.

3. The method of claim 1, wherein the valve flow rate comprises an estimated valve flow rate.

4. The method of claim 1, further comprising receiving, at the controller, additional feedback from a sensor coupled to the actuator, wherein the additional feedback represents a position, a velocity, or an acceleration of the actuator.

5. The method of claim 4, further comprising determining, via the controller, an actual speed of the actuator based on the additional feedback.

6. The method of claim 5, wherein the valve flow rate comprises an actual valve flow rate, and the method further comprises calculating, via the controller, the actual valve flow rate based on at least the actual speed of the actuator.

7. A method for controlling load dependent valve flow rate in a presence of an overrunning load in a bucket of a work vehicle, comprising:

receiving, at the controller, feedback from one or more pressure sensors, wherein the feedback represents one or more measured pressures from and/or to a hydraulic valve, and the hydraulic valve is coupled to an actuator coupled to the bucket with the overrunning load;

calculating, via the controller, a load pressure on the actuator based on the feedback;

receiving, at the controller, a first valve command for actuating the actuator to lower the bucket with the overrunning load, wherein the first valve command is received from an operator interface of the work vehicle, and wherein the valve command is associated with a first desired valve flow rate through the hydraulic valve and a first desired maximum speed of the actuator; and providing, via the controller, a second valve command based on a last calculated load pressure before receiving the first valve command, wherein the second valve command adjusts a valve opening area of the hydraulic valve so that a speed of the actuator corresponds to a maximum speed of the actuator for the last calculated load pressure.

8. The method of claim 7, further comprising saving, via the controller, the last calculated load pressure in a memory of the controller.

9. The method of claim 7, further comprising adjusting, via the controller, the first valve command to the second valve command based on the last calculated load pressure.

10. The method of claim 9, wherein adjusting the first valve command comprises saturating the first valve command to generate the second valve command.

11. The method of claim 9, wherein adjusting the first valve command comprises scaling the first valve command to generate the second valve command.

12. The method of claim 9, further comprising receiving, at the controller, additional feedback from a sensor coupled to the actuator, wherein the additional feedback represents a position, a velocity, or an acceleration of the actuator.

13. The method of claim 12, further comprising determining, via the controller, an actual speed of the actuator based on the additional feedback.

14. The method of claim 13, further comprising calculating, via the controller, an actual valve flow rate based on at least the actual speed of the actuator.

15. The method of claim 14, further comprising modifying the second valve command based on the actual valve flow rate.

16. The method of claim 7, further comprising:

receiving, at the controller, a third valve command for actuating the actuator to lower the bucket with the overrunning load subsequent to both the first valve command and the second valve command, wherein the third valve command is received from the operator interface of the work vehicle, and wherein the valve command is associated with a second desired valve flow rate through a hydraulic valve coupled to the actuator and a second desired maximum speed of the actuator; and providing, via the controller, a fourth valve command based on the last calculated load pressure before receiving the second valve command, wherein the fourth valve command adjusts the valve opening area of the hydraulic valve so that the speed of the actuator corresponds to the maximum speed of the actuator for the last calculated load pressure.

17. The method of claim 7, wherein the actuator comprises a hydraulic cylinder and flow through the hydraulic cylinder is recirculated, and wherein the one or more pressure sensors comprises a first pressure sensor and a second pressure sensor, and the one or more measured pressure comprise a first pressure measurement on a piston side of the hydraulic cylinder and a second pressure measurement on a rod side of the hydraulic cylinder.

18. A method for controlling actuator speed in a presence of an overrunning load in a bucket of a work vehicle, comprising:

receiving, at a controller, a first input from an operator interface of the work vehicle, wherein the first input comprises a selected target speed from among a plurality of target speeds for an actuator coupled to the bucket, wherein the plurality of target speeds range between 0 percent and 100 percent;

determining, via the controller, a maximum valve command for actuating the actuator to lower the bucket with the overrunning load based on the selected target speed, wherein the maximum valve command ranges between 0 percent and 100 percent, and wherein the maximum valve command is associated with a valve flow rate through a hydraulic valve coupled to the actuator;

determining, via the controller, whether a speed limitation feature is enabled;

adjusting, via the controller, the maximum valve command and providing the adjusted maximum valve command to the hydraulic valve, wherein the adjusted maximum valve command keeps the actuator from exceeding the target speed when the speed limitation feature is enabled; and providing, via the controller, the maximum valve command to the hydraulic valve unadjusted when the speed limitation feature is not enabled.

19. The method of claim 18, wherein adjusting the maximum valve command comprises saturating the maximum valve command.

20. The method of claim 18, wherein adjusting the maximum valve command comprises scaling the maximum valve command.

* * * * *